US006238305B1

(12) United States Patent
Umezawa et al.

(10) Patent No.: US 6,238,305 B1
(45) Date of Patent: May 29, 2001

(54) WOUND GOLF BALL

(75) Inventors: Junji Umezawa; Shinichi Kakiuchi, both of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/163,910

(22) Filed: Oct. 1, 1998

(30) Foreign Application Priority Data

Oct. 1, 1997 (JP) ..... 9-284724

(51) Int. Cl.[7] ..... A63B 37/06

(52) U.S. Cl. ..... 473/356

(58) Field of Search ..... 473/378, 356, 473/366, 361, 372, 373

(56) References Cited

U.S. PATENT DOCUMENTS 5,607,366 * 3/1997 Yokota et al. ..... 473/372
5,743,814 * 4/1998 Endo ..... 473/378
5,766,096 * 6/1998 Maruko et al. ..... 473/365

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

A wound golf ball in which a wound core consisting of a solid center and a thread rubber layer is enclosed with a cover has a surface hardness of 70–85 on JIS C hardness scale, and presents a contact area of 3.5–4.1 $cm^2$ with the club face of No. 9 iron driven at a head speed of 35 m/s. The ball is improved in control and distance in that it receives a more spin rate upon approach shots, but a less spin rate upon driver shots.

11 Claims, 1 Drawing Sheet

WOUND GOLF BALL

BACKGROUND OF THE INVENTION

1. Field of the Invention

This invention relates to a wound golf ball having satisfactory spin, feel and durability and featuring increased distance.

2. Prior Art

In prior art wound golf balls each having a solid center, thread rubber and a cover, the cover is often formed of ionomer resins and balata rubber. Covers of two-layer structure are also known. Although many attempts have been made on wound golf balls to improve the spin properties and distance thereof, there is still a desire for further improvements.

In general, the spin properties of golf balls are determined by an amount of deformation of the ball upon impact and the frictional force between the ball and the club face. The ball shows the tendency that the spin rate decreases as the deformation amount of the ball upon impact becomes greater, and also as the cover becomes harder.

In order to improve the controllability of the ball upon iron shots, it is required that the cover be made soft and the deformation amount of the ball be optimized relative to the cover hardness.

SUMMARY OF THE INVENTION

An object of the present invention is to provide a wound golf ball which has appropriate spin properties compatible with different clubs and which is improved in durability, hitting feel and flight distance.

The invention pertains to a wound golf ball comprising a wound core consisting of a solid center and a thread rubber layer thereon, and a cover surrounding the wound core. In order to improve the spin properties, hitting feel, durability and flight distance of the wound golf ball of this type, we made investigations on the respective components of the ball. We have found that by setting the surface hardness of the ball in the range of 70 to 85 on JIS C hardness scale, and setting the contact area of the ball with the club face of No. 9 iron driven at a relatively slow head speed in the range of 3.5 to 4.1 $cm^2$, the wound golf ball is optimized so as to fully meet the requirements of spin properties, hitting feel and durability and travel a longer distance.

The wound golf ball is further improved in performance by optimizing the diameter and deflection of the solid center and their relationship and/or by optimizing the density of the thread rubber layer.

According to the invention, there is provided a wound golf ball comprising a wound core consisting of a solid center and a thread rubber layer, and a cover around the wound core. The ball has a surface hardness of 70 to 85 on JIS C hardness scale. The ball presents a contact area with a club face of 3.5 to 4.1 $cm^2$ when the ball is hit with No. 9 iron at a head speed of 35 m/s.

In one preferred embodiment, the solid center has a diameter D of 30 to 36 mm and yields a deflection C of 0.8 to 4.0 mm under an applied load of 30 kg, and C and D satisfy the following relationship:

$$-0.15D+6.2 \leqq C \leqq -0.4D+16.$$

Also preferably, the thread rubber layer has a density of 0.65 to 0.85 $g/cm^3$.

DETAILED DESCRIPTION OF THE INVENTION

Figure 1:
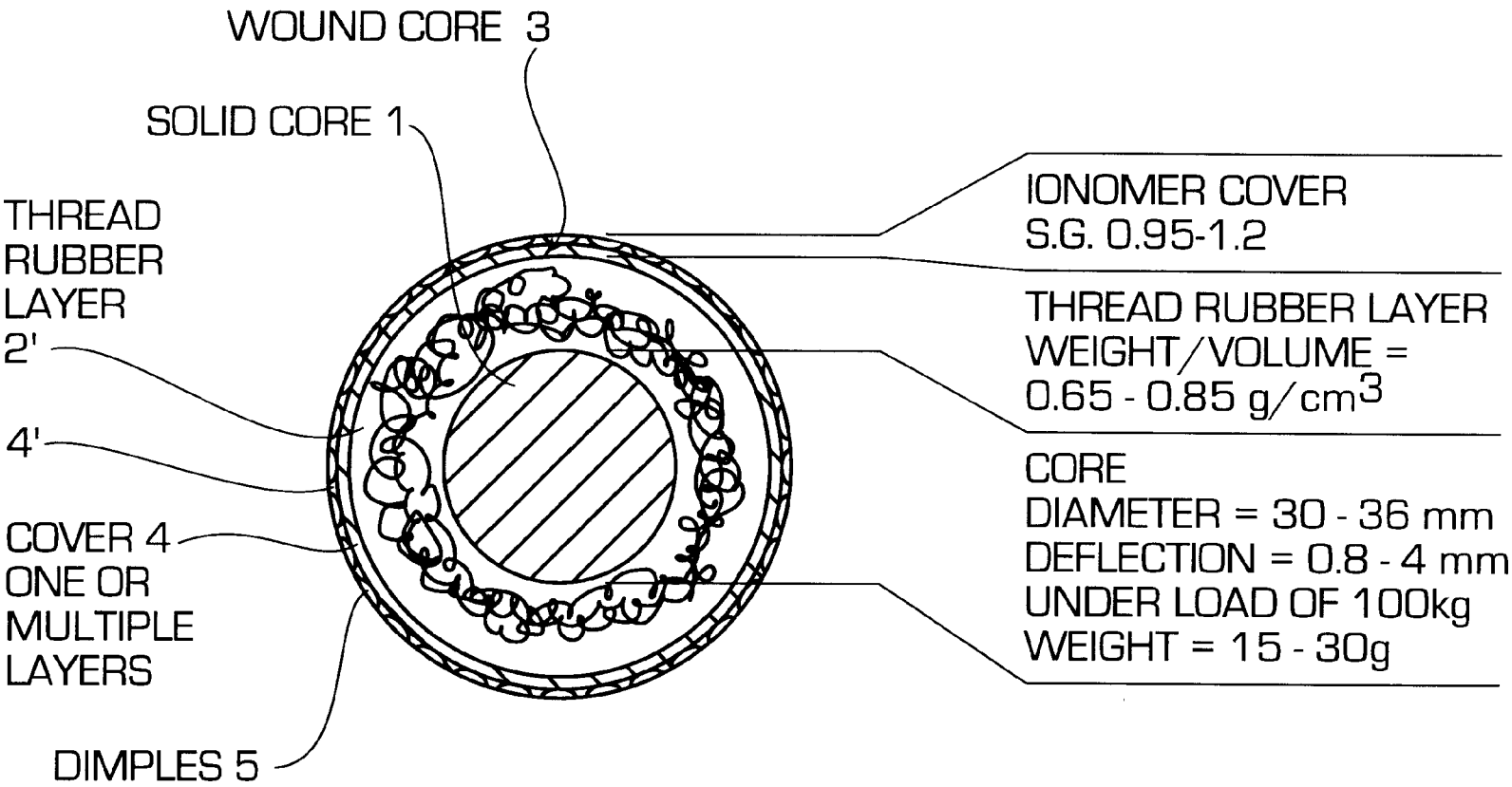
FIG. 1 is a schematic cross-section of a golf ball according to the invention.

The wound golf ball of the invention includes a wound core and a cover as illustrated in FIG. 1. The wound core 1 consists of a solid center and a thread rubber layer 2 formed by winding thread rubber about the solid center. The wound core is enclosed with the cover 3.

First, the solid center is described in detail. The solid center used herein may be formed of well-known materials. Typically, the solid center is formed by molding under heat and pressure a well-known rubber composition comprising base rubber blended with a co- crosslinking agent, peroxide, inert filler and other additives.

More particularly, the base rubber used herein may be polybutadiene rubber or a mixture of polybutadiene rubber and polyisoprene rubber as used in conventional solid centers although cis-1,4-polybutadiene rubber having at least 90% of cis-structure is preferred, especially for high resilience. The co-crosslinking agents which can be used herein include zinc and magnesium salts of unsaturated fatty acids such as acrylic acid and methacrylic acid and ester compounds such as trimethylpropane trimethacrylate. Zinc acrylate is preferred because high resilience is expectable. The amount of the co-crosslinking agent blended is preferably 15 to 30 parts by weight per 100 parts by weight of the base rubber though not limited thereto. Various peroxides are useful although dicumyl peroxide or a mixture of dicumyl peroxide and 1,1-bis(t-butylperoxy)-3,3,5-trimethylcyclohexane is preferred. The amount of the peroxide blended is preferably 0.5 to 1.5 parts by weight per 100 parts by weight of the base rubber. The inert fillers which can be blended herein include zinc oxide, barium sulfate, silica, calcium carbonate, and zinc carbonate, with zinc oxide and barium sulfate being commonly used. The amount of filler blended is adjusted as appropriate. For improving the resilience of the solid center, it is recommended to blend zinc oxide in an amount of at least 3 % by weight of the entire filler.

In the center-forming composition, other additives such as anti-oxidants may be added if desired. For example, since the step of winding thread rubber about the solid center often requires to freeze the solid center in dry ice in order to prevent the center from deforming, an oily substance such as aromatic oil may be blended in an amount of 2 to 10% by weight of the base rubber for facilitating freezing.

The solid center can be produced from the above-described composition by well-known me hods. For example, the solid center is produced by mixing base rubber and additives in a mixer such as a Banbury mixer or roll mill, introducing the compound into a mold, and heating at a sufficient temperature for the co-crosslinking agent and peroxide to exert their function, thereby curing the compound.

It is recommended that the solid center 1 has a diameter of 30 to 36 mm, especially 32 to 34 mm and yields a deflection or deformation of 0.8 to 4.0 mm, especially 1.2 to 3.6 mm under an applied load of 30 kg. Since the likelihood of the solid center deforming in the subsequent step of winding thread rubber thereon increases as the diameter of the solid center increases, the hardness of the solid center should be set relative to its diameter. Therefore, in addition to the above settings, C representing the deflection (mm) of the solid center under an applied load of 30 kg and D representing the diameter (mm) of the solid center should fall in the range:

$$-0.15D+6.2 \leqq C \leqq -0.4D+1.$$

If the diameter of the solid center 1 is less than 30 mm, the ball would acquire a too much spin rate upon driver shots, resulting in a shorter distance. With solid center diameter of more than 36 mm, the amount of thread rubber must be reduced, probably resulting in a reduced initial velocity, too much deformation upon impact, a reduced spin rate upon iron shots and/or poor controllability. If the deflection of the solid center is less than 0.8 mm, the desired initial velocity upon impact is not achievable. If the deflection is more than 4.0 mm, the solid center can be deformed during winding of thread rubber even when it is frozen. If the deflection C of the solid center relative to its diameter D is outside the above-defined range, the ball would become more susceptible to spin and inferior in distance and control even when the individual parameters are within the optimum ranges.

Although no particular limits are imposed on the weight and resilience of the solid center, it is preferred that the solid center has a weight of 15 to 30 grams, especially 17 to 28 grams, and a rebound height of at least 96 cm, especially 97 to 105 cm when dropped from a height of 120 cm onto a cylindrical iron base of 1.0 cm in diameter and 10 cm in height.

In the wound golf ball of the invention, thread rubber 2 is wound on the above-mentioned solid center to form a wound core. To this end, well-known methods may be used. Typically thread rubber 2 is wound under high tension on the solid center which has been frozen for preventing deformation although freezing is not essential.

Well-known types of thread rubber may be used. Parameters of thread rubber are not critical although it is preferred that the rubber thread used have a specific gravity of 0.93 to 1.1, especially 0.93 to 1, a width of 1.4 to 2 mm, especially 1.5 to 1.7 mm, and a thickness of 0.3 to 0.7 mm, especially 0.4 to 0.6 mm. The ratio of width to thickness is preferably from 3/10 to 4/10.

The thread rubber winding method is not critical as mentioned above. Any of random winding (also known as basket winding) and great circle winding methods may be used.

The degree of stretching of the thread rubber during winding should be high enough to ensure an appropriate deformation amount. If the stretching degree is too high, rubber threads may often break during winding leading to low production yields, and the durability and feel of the ball would be adversely affected. In most cases, the thread rubber is preferably stretched by a factor of 7 to 10 folds, especially 8 to 9 folds while it is wound on the center. Since it is recommended that spaces between overlapping rubber threads be distributed uniformly throughout the thread rubber layer in order to optimize the density of the thread rubber layer, the angle of intersection between rubber threads is preferably set in the range of 12° to 45°.

The thread rubber layer in the golf ball of the invention should preferably have a density (thread rubber total weight/volume of thread rubber layer) of 0.65 to 0.85 g/cm$^3$, especially 0.70 to 0.85 g/cm$^3$ in order to optimize the deformation amount of the ball upon impact. With a thread rubber layer density of less than 0.65 g/cm$^3$, the deformation amount of the ball can be increased. If so, the spin rate can be reduced and the controllability be impaired even if the surface hardness of the ball is set relatively low. A thread rubber layer density of more than 0.85 g/cm$^3$ would lead to a smaller deformation amount of the ball, unpleasant hitting feel and a too much spin rate upon driver shots and hence, a shorter distance.

In the golf ball of the invention, the wound core is enclosed with a cover 4 which may be a single layer cover or of multilayer structure consisting of at least two layers.

When the cover 4 is a single layer cover or of multilayer structure, the single layer cover or the cover outer layer may be formed of any of well-known cover stocks, for example, ionomer resins alone or in admixture with an ethylene-methacrylic acid copolymer.

The ionomer resin used herein is selected from well-known ones, for example, Himilan 1855, 1856 and 1652 from Mitsui-duPont Polychemical K.K., and Surlyn 8120, 7930, AM7311 and AM8542 from E.I. duPont. Ionomer resins may be used alone or in admixture of two or more. A mixture of two or more ionomer resins each having a neutralizing metal ion, and especially a mixture of two or more ionomer resins having different neutralizing metal ions is preferred. Exemplary combinations of neutralizing metal ions are Zn/Na, Mg/Li and Mg/Na.

The ethylene-methacrylic acid copolymers are commercially available, for example, as Nucrel N1560, AN4311, AN4213C and N035C (Mitsui-duPont Polychemical K.K.). It is recommended to use ethylene-methacrylic acid copolymers having a Shore D hardness of up to 50, especially 25 to 50.

When the cover stock is a mixture of an ionomer resin and an ethylene-methacrylic acid copolymer, the amount of the ethylene-methacrylic acid copolymer blended should be less than 50% by weight, preferably 20 to 45% by weight of the entire cover stock. With an ethylene-methacrylic acid copolymer content of 50% by weight or more, the resulting (outer) cover is susceptible to scraping or marring upon impact and less durable.

The cover stock preferably has a specific gravity of 0.95 to 1.2.

When the cover 4 is formed of the cover stock described above, its gage (or radial thickness) is preferably 1 to 3.2 mm, especially 1.5 to 2.5 mm for the single layer cover and 0.4 to 1.6 mm, especially 0.6 to 1.4 mm for the cover outer layer of the two-layer structure cover. With a cover gage below the range, the spin rate upon approach shots would not be increased as desired, and the ball would become less durable. A cover gage beyond the range would lead to reductions of resilience and distance.

Also preferably, the hardness of the cover is adjusted to a Shore D hardness of 38 to 52, especially 42 to 49. A cover with a Shore D hardness of less than 38 is susceptible to scuffing upon iron shots whereas a cover with a Shore D hardness of more than 52 fails to add to the spin rate upon iron shots.

In the embodiment wherein the cover of the golf ball according to the invention is of two-layer structure consisting of an outer layer and an inner layer, the outer layer is as described above. The cover inner layer is formed of any of well-known cover stocks. Use is often made of ionomer resins, for example, Himilan 1555, 1557, 1705 and 1706 commercially available from Mitsui-duPont Polychemical K.K. Ionomer resins may be used alone or in admixture of two or more. It is preferred to use a mixture of at least two ionomer resins having different neutralizing metal ions. Exemplary combinations of neutralizing metal ions are Zn/Na, Mg/Li and Mg/Na.

The cover inner layer should preferably have a Shore D hardness of 55 to 68, especially 58 to 68. Preferably, the hardness of the cover inner layer is higher than the hardness of the cover outer layer. The difference between the hardness of the cover inner layer and the hardness of the cover outer layer is preferably at least 5 Shore D units, more preferably at least 10 Shore D units, most preferably 10 to 25 Shore D units.

Also, the cover inner layer should preferably have a gage of 0.6 to 1.6 mm, especially 0.8 to 1.6 mm. Too thin the cover inner layer would adversely affect the durability and feel of the ball. Too thick the cover inner layer would adversely affect the resilience of the ball, failing to provide satisfactory flight performance. The cover inner layer is preferably adjusted to a specific gravity of 0.95 to 1.2, especially 0.95 to 1.15 in order to provide an appropriate moment of inertia though the invention is not limited thereto.

In the embodiment wherein the cover 4 is of two-layer structure 4,4, it is recommended that the overall gage of the cover, that is, the sum of the gages of the cover outer and inner layers is 1 to 3.2 mm, especially 1.5 to 2.5 mm. Further preferably, the ratio of the gage of the inner layer to the gage of the outer layer is from 3/7 to 7/3.

The wound core 3 composed of the solid center and the thread rubber layer is enclosed with the cover of single or multi-layer structure by well-known processes. For example, the wound core is enclosed with the single layer cover by injection molding the cover stock on the wound core or by preforming a pair of hemispherical half cups from the cover stock, encasing the wound core in the half cups, and effecting compression molding at 110 to 160° C. for 2 to 10 minutes. In the case of the two-layer structure cover, the wound core is enclosed with the cover, for example, by successively injection molding inner and outer cover stocks on the wound core. Alternatively, the cover may be applied by preforming hemispherical half cups from inner and outer cover stocks, joining inner and outer half cups together to form a pair of half cups of two-layer structure, encasing the wound core in the half cups, and effecting compression molding at 110 to 160° C. for 2 to 10 minutes. In a further process, the cover is formed by encasing the wound core in a pair of inner half cups, effecting compression molding at 110 to 160° C. for 2 to 10 minutes, placing the core in an injection mold, and injection molding an outer cover stock. Where the cover is of multilayer structure consisting of three or more layers, the cover layers may be formed in the order from inside to outside layers by any of the above-mentioned techniques.

The wound golf ball should have a surface hardness of 70 to 85, preferably 72 to 80, on JIS C hardness scale. A ball with a surface hardness of less than 70 would acquire a spin rate that is too high upon driver shots, resulting in a shorter distance. A ball with a surface hardness of more than 85 would acquire a too low spin rate upon iron shots, losing the ease of control.

In addition to the surface hardness, the wound golf ball of the invention should have a contact area with a club face of 3.5 to 4.1 $cm^2$, especially 3.6 to 4.0 $cm^2$, when the ball is hit with No. 9 iron at a head speed of 35 m/s because the control, hitting feel and durability of the ball are improved thereby. More specifically, the contact area is defined, when the ball is hit with No. 9 iron at the predetermined head speed, as the area of the ball in contact with the club face. Typically, No. 9 iron has a plurality of grooves across the club face. Although it can actually happen that the ball does not come into contact with concave surfaces in grooves, the contact area is considered as the overall area of a region of the club face in contact with the ball provided that the club face is a planar surface. On actual measurement, the contact area is determined by applying a pressure sensitive sheet (e.g., Prescale by Fuji Photo Film K.K. or Shot Mark by Lite Shokai K.K.) to the club face, and hitting a ball with the club. The region of the sheet that has contacted the ball changes its color, for example, to red. The area delimited by the boundary of the color changed region is determined.

Further the wound golf ball should preferably have a deflection or deformation of 2.4 to 3.6 mm, especially 2.6 to 3.4 mm, under an applied load of 100 kg, because improvements in durability and hitting feel are achieved.

Like conventional golf balls, the wound golf ball of the invention is formed with a multiplicity of dimples 5 in the outer surface of the cover. No particular limits are imposed on the number, diameter, depth, and arrangement of dimples 5. The number of dimples is usually from 350 to 500, preferably from 370 to 480, and more preferably 390 to 450. Two or more types of dimples which differ in diameter and/or depth are acceptable. Typically, the dimple diameter is set within a range of 1.5 to 4.5 mm, especially 2.0 to 4.0 mm and the depth is set within a range of 0.15 to 0.25 mm, especially 0.16 to 0.22 mm. Known arrangements such as octahedral, dodecahedral and icosahedral arrangements may be employed.

Further preferably, dimples satisfy dimple optimizing factors. For example, dimples may be formed so as to provide a dimple surface coverage of at least 65%, and preferably 70 to 80%. The dimple surface coverage is the sum of dimple areas divided by the entire surface area of the imaginary spherical surface of the ball which is regarded as a smooth sphere (free of dimples). When the dimple surface coverage is less than 65%, it may not be possible to obtain the increased flight distance. Also, the percent dimple volume may be set at 0.76 to 1.0%, and preferably 0.78 to 0.94%. The percent dimple volume is (total dimple volume)/(ball volume)×100 wherein "ball volume" refers to the imaginary volume of the ball which is regarded as a smooth sphere (free of dimples), and "total dimple volume" refers to the sum of the volumes of the individual dimples. When the percent dimple volume is less than 0.76%, the ball may travel a too high trajectory, resulting in a shorter carry. When the percent dimple volume is greater than 1.0%, the trajectory may become too low, similarly resulting in a shorter carry.

The wound golf balls of the invention must have a diameter and weight in accordance with the Rules of Golf, specifically a diameter of not less than 42.67 mm and a weight of not greater than 45.93 g.

Since the wound golf ball is improved in spin properties in that a more spin rate is acquired upon approach shots, which is effective for improving controllability, and a less spin rate is acquired upon driver shots, which is effective for increasing the flight distance. Additionally, the ball is fully durable and offers a pleasant feel when hit.

EXAMPLE

Examples of the invention are given below by way of illustration, and are not intended to limit the invention.

All parts are by weight.

Examples 1–6 & Comparative Examples 1–5

Solid centers were prepared by kneading the rubber compositions shown in Table 1 in a kneader, followed by compression molding in a mold at 150° C. for 15 minutes. The solid centers were measured for diameter, weight, specific gravity, hardness and rebound. The hardness was expressed by a deflection (mm) of the solid center under an applied load of 30 kg. The rebound was expressed by a rebound height (cm) when the solid center was dropped from a height of 120 cm. The results are also shown in Table 1.

TABLE 1

| | ① | ② | ③ | ④ | ⑤ | ⑥ | ⑦ |
|---|---|---|---|---|---|---|---|
| Composition (pbw) | | | | | | | |
| Polybutadiene rubber | 100.0 | 100.0 | 100.0 | 100.0 | 100.0 | 100.0 | 100.0 |
| Zinc acrylate | 21.0 | 15.0 | 21.0 | 26.0 | 10.0 | 25.0 | 21.0 |
| Zinc oxide | 20.0 | 20.0 | 20.0 | 15.0 | 20.0 | 20.0 | 15.0 |
| Barium sulfate | 44.0 | 46.0 | 26.5 | 14.0 | 47.0 | 42.0 | 17.0 |
| Dicumyl peroxide | 1.2 | 1.2 | 1.2 | 1.2 | 1.2 | 1.2 | 1.2 |
| Solid center | | | | | | | |
| Diameter (mm): D | 32.0 | 32.0 | 33.8 | 35.5 | 32.0 | 32.0 | 35.5 |
| Weight (g) | 23.7 | 23.8 | 26.4 | 28.8 | 23.8 | 23.7 | 28.7 |
| Specific gravity | 1.38 | 1.38 | 1.30 | 1.22 | 1.38 | 1.38 | 1.22 |
| Hardness (mm): C | 1.80 | 2.65 | 1.82 | 1.40 | 3.35 | 1.30 | 2.30 |
| −0.15 × D + 6.2 | 1.400 | 1.400 | 1.130 | 0.875 | 1.400 | 1.400 | 0.875 |
| −0.4 × D + 16 | 3.2 | 3.2 | 2.48 | 1.8 | 3.2 | 3.2 | 1.8 |
| Rebound (cm) | 98.5 | 100.4 | 98.7 | 97.7 | 103.2 | 95.1 | 98.2 |

A rubber thread of the composition and parameters shown below was wound on each solid center while the angle of intersection was set at 20 to 40°. Wound cores having an outer diameter of about 39.3 mm were obtained.

| Rubber thread | |
|---|---|
| Polyisoprene rubber | 70 parts |
| Natural rubber | 30 parts |
| Zinc oxide | 1.5 parts |
| Stearic acid | 1.0 part |
| Vulcanization accelerator | 1.5 parts |
| Sulfur | 1.0 part |
| Dimensions Width | 1.5 mm |
| Thickness | 0.55 mm |

Each of cover stocks of the compositions shown in Table 2 was kneaded in a twin screw extruder and molded into hemispherical half cups. The half cups for inner and outer layers were joined in the combination shown in Table 3, forming half cups of two-layer structure. Note that the cover stocks were measured for Shore D hardness and melt flow index (MFR) at 190° C. according to JIS K-6760, with the results shown in Table 2.

Each wound core was enclosed in a pair of half cups of two-layer structure. This was compression molded at 145° C. for 5 minutes. In this way, there were produced wound golf balls having a total number of 396 dimples providing a dimple surface coverage of 77% and a percent dimple volume of 0.86%.

The wound golf balls were examined for flight performance, spin and contact area by the following tests.

The results are shown in Table 3. It is to be noted that Comparative Example 5 was a two-piece solid golf ball which was examined for spin and contact area.

Flight Performance

Using a swing robot by True Temper Co., the ball was hit with a driver (J's Metal Loft by Bridgestone Sports Co., Ltd., loft angle 9.5°) at a head speed of 45 m/s (W#1/HS45). Spin, initial velocity, elevation angle, carry and total distance were measured.

Spin

Using the same swing robot as above, the ball was hit with No. 9 iron (Classical Edition by Bridgestone Sports Co., Ltd.) at a head speed of 35 m/s (I#9/HS35). A spin rate was measured.

Contact Area

Pressure sensitive sheets were attached to the club faces of the driver and No. 9 iron. The ball was hit with the driver at a head speed of 45 m/s and with the No. 9 iron at a head speed of 35 m/s. The boundary of the region of the sheet which changed its color as a result of impact was drawn, and the area delimited by the boundary was computed. The contact areas obtained with 5 balls were averaged.

TABLE 2

| Cover | A | B | C | D | E |
|---|---|---|---|---|---|
| Composition (pbw) | | | | | |
| H1554 | | | | 100 | |
| H1650 | | | 20 | | |
| H1855 | | 35 | 30 | | |
| H1706 | | | | | 50 |
| H1707 | | | | | 50 |
| S7930 | 20 | | | | |
| S8120 | | 35 | 30 | | |
| AM8542 | 40 | | | | |
| AN4311 | 40 | 30 | | | |
| N1560 | | | 20 | | |
| Barium sulfate | 1 | 1 | 1 | 1 | 1 |
| Titanium oxide | 2 | 2 | 2 | 2 | 2 |
| Dispersant/pigment | 1 | 1 | 1 | 1 | 1 |
| MFR (g/10 min) | 3.4 | 2.8 | 2.1 | 1.0 | 1.0 |
| Shore D hardness | 43 | 46 | 51 | 55 | 61 |

Note:
H1554: Zn ion neutralized ionomer resin by Mitsui-duPont Polychemical K. K.
H1650: Zn ion neutralized ionomer resin by Mitsui-duPont Polychemical K. K.
H1855: Zn ion neutralized ionomer resin by Mitsui-duPont Polychemical K. K.
H1706: Zn ion neutralized ionomer resin by Mitsui-duPont Polychemical K. K.
H1707: Na ion neutralized ionomer resin by Mitsui-duPont Polychemical K. K.
S7930: Li ion neutralized ionomer resin by E. I. duPont
S8120: Na ion neutralized ionomer resin by E. I. duPont
AM8542: Mg ion neutralized ionomer resin by E. I. duPont
AN4311: ethylene-methacrylic acid copolymer by Mitsui-duPont Polychemical K. K.
N1560: ethylene-methacrylic acid copolymer by Mitsui-duPont Polychemical K. K.

TABLE 3

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Solid center | | | | | | | | | | | |
| Composition | ① | ② | ① | ① | ③ | ④ | ⑤ | ① | ⑦ | ④ | — |
| Diameter (mm) | 32.0 | 32.0 | 32.0 | 32.0 | 33.8 | 35.5 | 32.0 | 32.0 | 35.5 | 35.5 | — |
| Weight (g) | 23.7 | 23.8 | 23.7 | 23.7 | 26.4 | 28.8 | 23.8 | 23.7 | 28.7 | 28.8 | — |

TABLE 3-continued

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Hardness range (mm) | 1.4~3.2 | 1.4~3.2 | 1.4~3.2 | 1.4~3.2 | 1.13~2.48 | 0.875~1.8 | 1.4~3.2 | 1.4~3.2 | 0.875~1.8 | 0.875~1.8 | — |
| Hardness (mm) | 1.80 | 2.65 | 1.80 | 1.80 | 1.82 | 1.40 | 3.35 | 1.80 | 2.30 | 1.40 | — |
| Cover inner layer | | | | | | | | | | | |
| Composition | E | E | E | E | E | E | E | E | E | E | — |
| Shore D hardness | 61 | 61 | 61 | 61 | 61 | 61 | 61 | 61 | 61 | 61 | — |
| Gage (mm) | 1.0 | 1.0 | 1.0 | 1.0 | 1.0 | 1.0 | 1.0 | 1.0 | 1.0 | 1.0 | — |
| Cover outer layer | | | | | | | | | | | |
| Composition | A | A | B | C | A | B | A | D | B | B | — |
| Shore D hardness | 43 | 43 | 46 | 51 | 43 | 46 | 43 | 55 | 46 | 46 | — |
| Gage (mm) | 0.9 | 0.9 | 0.9 | 0.9 | 0.9 | 0.9 | 0.9 | 0.9 | 0.9 | 0.9 | — |
| Winding tension (g) | 550 | 800 | 600 | 600 | 700 | 700 | 800 | 550 | 750 | 400 | — |
| Thread rubber layer | | | | | | | | | | | |
| Volume ($cm^3$) | 14.5 | 14.5 | 14.5 | 14.5 | 11.9 | 8.5 | 14.6 | 14.5 | 8.6 | 8.4 | — |
| Density ($g/cm^3$) | 0.748 | 0.781 | 0.762 | 0.755 | 0.701 | 0.673 | 0.785 | 0.750 | 0.681 | 0.644 | — |
| Surface hardness (JIS-C) | 76 | 77 | 80 | 83 | 76 | 80 | 77 | 86 | 80 | 80 | 83 |
| Ball | | | | | | | | | | | |
| Diameter (mm) | 42.68 | 42.68 | 42.68 | 42.67 | 42.68 | 42.67 | 42.67 | 42.68 | 42.68 | 42.68 | 42.68 |
| Weight (g) | 45.2 | 45.2 | 45.3 | 45.3 | 45.3 | 45.2 | 45.2 | 45.2 | 45.2 | 45.3 | 45.1 |
| Contact area ($cm^2$) | | | | | | | | | | | |
| W#1/HS45 | 5.4 | 5.7 | 5.3 | 5.3 | 5.5 | 5.5 | 6.3 | 5.4 | 6.4 | 6.0 | 4.8 |
| I#9/HS35 | 3.8 | 3.9 | 3.7 | 3.7 | 3.9 | 3.8 | 4.3 | 3.8 | 4.4 | 4.2 | 3.4 |
| W#1/HS45 | | | | | | | | | | | |
| Spin (rpm) | 3150 | 3050 | 3040 | 2970 | 2950 | 3010 | 2880 | 2770 | 2680 | 2800 | — |
| Initial velocity (m/s) | 65.5 | 65.8 | 65.6 | 65.6 | 65.7 | 65.6 | 65.5 | 65.6 | 65.6 | 64.8 | — |
| Elevation angle (°) | 12.1 | 12.1 | 12.0 | 11.9 | 11.9 | 12.0 | 11.8 | 11.8 | 11.7 | 11.7 | — |
| Carry (m) | 212.5 | 213.6 | 212.7 | 211.8 | 212.0 | 213.0 | 210.0 | 209.5 | 208.6 | 207.9 | — |
| Total (m) | 224.0 | 225.1 | 224.3 | 225.0 | 225.6 | 225.0 | 223.8 | 224.0 | 222.0 | 220.5 | — |
| I#9/HS35 | | | | | | | | | | | |
| Spin (rpm) | 9420 | 9350 | 9180 | 9050 | 9250 | 9000 | 8750 | 8680 | 8250 | 8800 | 8970 |

Since the surface hardness of the ball and the contact area of the ball with the club face of No. 9 iron driven at a head speed of 35 m/s are optimized, the wound golf balls within the scope of the invention acquire a greater spin rate upon approach shots, but a less spin rate upon driver shots. That is, the balls have improved spin properties providing a compromise between controllability and distance.

In contrast, the golf balls of Comparative Examples 1, 3 and 4 wherein the contact area with the club face is too great and the golf balls of Comparative Example 2 wherein the surface hardness (JIS C scale) is too high acquire too small spin rates when hit with different clubs, resulting in losses of control and distance. The two-piece solid golf ball of Comparative Example 5 acquire a less spin rate upon iron shots and is thus less controllable although it satisfy the requirements of the invention regarding the surface hardness and contact area.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A wound golf ball comprising; a wound core consisting of a solid center having a diameter D of 30 to 36 mm and a deflection C of 0.8 to 4.0 mm under an applied load of 30 kg, and C and D satisfy the following relationship: $-0.15D+6.2 \leqq C \leqq -0.4D+16$, a thread rubber layer having a density of 0.65 to 0.85 $g/cm^3$, and a cover, said ball having a surface hardness of 70 to 85 on JIS C hardness scale, and the ball has a contact area with a club face of 3.5 to 4.1 $cm^2$ when the ball is hit with No. 9 iron at a head speed of 35 m/s.

2. The wound golf ball of claim 1, wherein the cover is of two-layer structure of an outer cover layer and an inner cover layer.

3. The wound golf ball of the claim 1, wherein the gage of the outer cover layer is 0.6 to 1.4 mm.

4. The wound golf ball of claim 1, wherein said solid center has a weight in the range of 15 to 30 grams.

5. The wound golf ball of claim 1, wherein a density of thread rubber total weight/volume of thread rubber layer is in the range of 0.55 to 0.85 $g/cm^3$.

6. The wound golf ball of claim 1, wherein said cover is a single layer.

7. The wound golf ball of claim 1, wherein said cover has a thickness in the range of 1 to 3.2 mm.

8. The wound golf ball of claim 1, wherein said cover has a hardness in the range of 38 to 52 on Shore D.

9. The wound golf ball of claim 2, wherein said cover inner layer has a Shore D hardness in the range of 55 to 68.

10. The wound golf ball of claim 2, wherein a difference between the hardness of the cover inner layer and the cover outer layer is at least 5 Shore D units.

11. The wound golf ball of claim 2, wherein the sum of the gages over the cover inner and outer layers is in the range of 1 to 3.2 mm.

* * * * *